US006009586A

United States Patent [19]

Hawkes et al.

[11] Patent Number: 6,009,586

[45] Date of Patent: Jan. 4, 2000

[54] TRUSS AND PANEL SYSTEM FOR ACCESS RAMPS

[75] Inventors: E. Gerry Hawkes, Woodstock; Julian Goodrich, S. Burlington, both of Vt.

[73] Assignee: Vermont Center for Independent Living, Inc., Montpelier, Vt.

[21] Appl. No.: 09/038,692

[22] Filed: Mar. 9, 1998

[51] Int. Cl.[7] ..... E01D 19/00

[52] U.S. Cl. ..... 14/4; 14/69.5; 14/73

[58] Field of Search ..... 14/2.4, 3, 4, 5, 14/13, 14, 73, 69.5

[56] References Cited

U.S. PATENT DOCUMENTS

| | | |
|---|---|---|
| 838,485 | 12/1906 | Whiteside . |
| 3,103,026 | 9/1963 | Hahn . |
| 3,221,461 | 12/1965 | Grunfeld . |
| 3,328,818 | 7/1967 | Melcher . |
| 3,438,076 | 4/1969 | Sedlacek . |
| 4,151,695 | 5/1979 | Johnson . |
| 4,200,946 | 5/1980 | Lawrence . |
| 4,458,620 | 7/1984 | Bingham . |
| 4,649,588 | 3/1987 | Taylor . |
| 4,912,795 | 4/1990 | Johnson . |
| 4,945,595 | 8/1990 | Meriweather . |
| 4,965,903 | 10/1990 | Bisch . |
| 5,152,632 | 10/1992 | Hawkes . |
| 5,414,885 | 5/1995 | Berlin et al. . |
| 5,499,888 | 3/1996 | Hawkes . |
| 5,570,486 | 11/1996 | Wiedeck . |
| 5,724,691 | 3/1998 | Wiedeck et al. ..... 14/2.4 |

*Primary Examiner*—James A. Lisehora

*Attorney, Agent, or Firm*—Jacobson, Price, Holman & Stern, PLLC

[57] ABSTRACT

A ramp structure which may be constructed quickly to provide temporary or permanent access to all individuals between two areas of different elevation. A truss design allows long spans to form a bridge without the need for intermediate supports and related support foundations. A truss cross-connector is firmly wedged in place between two trusses and allows the quick, solid joining of two trusses without fasteners to form a strong and stable assembly to serve as ramps, bridges, elevated walkways, etc. The truss cross-connector has resistance to bending and supports the edge of a surface panel and provides a retaining pocket for the surface panel. The truss cross-connector firmly supports the trusses in an upright position when the trusses are used as railings. Surfacing panels placed between the truss cross-connectors provide a high quality, long lasting surface which is quickly installed for temporary or permanent installations, but which can be easily removed for reuse. The truss cross-connector also prevents casual removal of a closely fitting surface panel. A special tool is included in the system for easy disassembly of light trusses of this design without damage to the components. The design of a truss/panel ramp system can be easily disassembled and reused for temporary or permanent installations and meets Americans with Disabilities Act guidelines.

17 Claims, 6 Drawing Sheets

TRUSS AND PANEL SYSTEM FOR ACCESS RAMPS

FIELD OF THE INVENTION

The truss and panel system of the present invention provides a quickly constructed, high quality, economical access ramp, bridge, gangway, and the like which can be easily disassembled and reused.

BACKGROUND OF THE INVENTION

The Americans with Disabilities Act (ADA) was signed on Jul. 26, 1990 as Public Law 101-336 (42 U.S.C. Sec. 12101 et seq). The ADA generally became effective on Jan. 26, 1992. This landmark federal legislation opens up services and employment opportunities to the 43 million Americans with disabilities. The intent of the law was to strike a balance between the reasonable accommodation of an individual's needs and the capacity of private and public entities to respond.

The law includes five titles that prohibit discrimination against disabled persons within the United States. Title II sets forth the applicable structural accessibility requirements for public entities. Title III sets forth the applicable structural accessibility requirements for private entities.

Under the law, public accommodations such as hotels, restaurants, theaters, stores, offices, transit stations, museums, parks, schools, social service agencies, and gyms must not discriminate against individuals with disabilities.

In existing facilities, barriers must be removed when such removal can be accomplished without much difficulty or expense. If not, alternative methods of making goods and services available must be in place, if such methods are readily achievable. New facilities must be accessible unless structurally impracticable.

To comply with the requirements of the ADA, it is often necessary to erect an enabling structure to facilitate access of disabled individuals to a difficult to access area. This may include traversing of an uneven terrain or other obstacles so as to provide equal access to all individuals.

SUMMARY OF THE INVENTION

Accordingly, it is an object of the present invention to provide a ramp structure which may be constructed quickly to provide temporary or permanent access to all individuals between two areas of different elevation.

It has been determined that the most practical way of achieving this object is with a truss and panel design. A truss design allows long spans to form a bridge without the need for intermediate supports and related support foundations.

The present invention includes a truss cross-connector which is firmly wedged in place between two trusses and allows the quick, solid joining of two trusses without fasteners to form a strong and stable assembly to serve as ramps, bridges, elevated walkways, etc. The truss cross-connector has resistance to bending and supports the edge of a surface panel and provides a retaining pocket for the surface panel. The truss cross-connector firmly supports the trusses in an upright position when the trusses are used as railings.

The truss is designed to receive self-locking cross-connectors. Surfacing panels placed between the truss cross-connectors provide a high quality, long lasting surface which is quickly installed for temporary or permanent installations, but which can be easily removed for reuse. The truss cross-connector also prevents casual removal of a closely fitting surface panel.

A special tool is included in the system for easy disassembly of light trusses of this design without damage to the components. The design of a truss/panel ramp system of the present invention can be easily disassembled and reused for temporary or permanent installations and meets ADA guidelines.

One preferred truss and panel ramp system is 16 feet long by 4 feet wide. The two trusses are 37 inches high. Depending on the application, any of these dimensions may be changed. However, decreasing the height of the truss decreases the load bearing capacity unless the strength of the materials used to build the truss is increased. A truss height of 37 inches provides ample strength and puts the top of the truss at a height of 35.5 inches above the ramp surface so the truss can double as a hand rail.

ADA guidelines call for a railing height in the range of 34–38 inches. The 4-foot travel width of the ramp exceeds ADA's minimum 36-inch requirement.

The two trusses are made from one-inch square steel tubing and 2×2-inch steel angle, welded together. The tubing which forms the top rail has a ⅛" wall thickness to provide extra bending strength should the tubing be struck or heavily loaded from above midway between the truss web attachment points.

The truss web is made from 16 gauge wall tubing. The bottom chord is made from 2×2"×3/16" steel angle to provide a solid anchoring point for welding the bottom ends of the truss web and to provide a good seat for the bottom connectors which join the two spaced trusses. A variety of other strong rigid materials may be used to construct similar trusses, such as aluminum, fiberglass, or laminated wood. Also a variety of truss web configurations may be used as long as bottom vertices of truss web members occur at intervals to provide locations for seating the cross-connectors.

Upper vertices of the truss web are preferably spaced at exactly two-foot intervals. Opposed lower vertices are offset by one-foot. Thus, each upper vertex is exactly halfway between two lower vertices. Both ends of the top rail extend one foot beyond the bottom chord to provide good handrail accessibility and a clean, safe design. To span a gap between a leading edge of the ramp and the ground, either a bottom connector will be located between the first web vertices with a tapered leading edge built in or a panel with a tapered edge will be utilized.

A top vertex of the truss web is welded to the underside of the top rail or chord. The top rail is preferably one-inch square tubing, but it can be a larger size or a range of cross-sectional shapes such as round, half-round, oval, channel or angle. Cross-sections of the top rail may be solid as well as hollow, but hollow rails give the best strength to weight ratios. Depending on the material used for truss fabrication, adhesive bonding, bolting, riveting, etc. may be used instead of welding. The top rail is smooth and a small enough diameter to allow easy hand gripping without the risk of any snagging or catching on protrusions or sharp edges.

The vertical flange of the L-shaped angle which forms the bottom chord is welded, bonded or otherwise fastened to the outside ends at the bottom of the web members to provide joint strength and resistance against twisting and flexing. The horizontal flange of the L-shaped angle provides a lip to support the bottom connectors and the panel edges.

A small gap is left between the truss web members at the bottom vertex to create a pocket for the cross-connectors which join the bottoms of two trusses together and also support a travel surface (panels) between the two trusses. The cross-connector is forced down into a bottom vertex of the truss where it is locked into position by the H-tabs of the cross connector positioned on the inside and outside of the truss web members and by the pocket formed by the small gap between truss web members at the vertex. The H-tabs firmly lock the cross-connector and trusses together which makes for an extremely stable assembly with virtually no loose play in the railings. The cross-connector is in the locked position when it is forced all the way down into the pocket of a bottom vertex of the truss webs.

The parallel extending tabs of the H-tab assembly are located at the end of a cross-connector. The tabs are of approximately 3 inches overall length with exactly a one inch separation distance between the inside of the tabs to match with the one inch square tube of the trusses onto which the H-tab assembly locks. The tabs are constructed of one inch wide by ¼ inch thick flat steel welded together. The center (or crossbar) of the H is a vertical piece and the sides (or tabs) of the H tab assembly are horizontal pieces.

The center or crossbar which forms the H, extends down to join a one inch high rib that runs across the center of the length of the cross-connector to form a right-angled corner which seats into a bottom vertex pocket formed by the L-angled steel bottom chord and the ¼" gap between the truss web members at the bottom vertex. The center or crossbar of the H extends down 2 inches below the tabs so that the crossbar and the cross rib to which it is joined rest on the horizontal lip of the L-angled steel which forms the bottom chord of the truss before the tabs come in contact with the top edge of the L-angle steel which forms the bottom chord.

To support a four foot wide ramp surface, the ¼"×3" wide plate that forms the bottom of the cross-connector is 46" long to fit precisely between the horizontal lips of the L-angle which form the bottom chords of the parallel trusses. When the cross-connector is fully seated and locked into the trusses, the bottom plate of the cross-connector is on the same plane as the horizontal lip of the L-angle that forms the bottom chord of each truss so that a 2'×4' surfacing panel dropped into position between the spaced cross-connectors will be supported equally on all edges.

If the cross-connector only has a cross rib on the bottom of the plate, conventional surfacing materials such as plywood sheets and lumber can be laid over the top of the connectors. However, in most applications it is best to lay a surfacing panel into the pockets formed by having a cross rib on top of the cross-connector.

The ¼"×1" center rib gives sufficient bending strength. If additional bending strength is required, the height of the rib can be increased and/or a rib can be added on the underside of the cross connector. Also the underside could be designed as a simple mini-truss having a triangular shape, increasing in height towards a center of the cross-connector.

A surface panel is specifically designed to drop into place in the pocket formed by the cross-connectors and the bottom chords of the trusses. The cross rib of the cross-connectors is slightly lower than the thickness of the surface panel.

The surface panels can be molded from structural plastic in a 2'×4' size with integral strengthening ribs on the underside, drainage holes through the surface and a traction pattern on the top surface. These panels will have ribbing capable of supporting 100 pounds per square foot (psf) live loadings. The ribs are designed so that additional strengthening bars may be added between the ribs to increase load bearing capacity, if needed. Depending upon the application, panels may be made of other materials and in other sizes.

When panels are sized to closely fit the width of the truss assembly, the ¼" thickness of the inside H-tab is sufficient to prevent the panels from being lifted out of their pockets without disassembly of the cross-connector from its seated position in the vertex of the truss web members. This feature prevents undesired removal of the panels. Inside H-tabs can be made thicker to increase the tolerance of the fit and still achieve locking of the panels into their pockets.

When the panels are designed to be of close enough tolerance to lock in place, the edge of the next panel is placed with its long edge on the previously installed cross-connector and the next cross-connector to be installed is laid against the opposite edge of the panel. The panel edge and cross-connector are lowered into position between the trusses. The H-tabs of the cross-connector will then be loosely straddling the truss web members on each side and must be forced, along with the panel, down into the vertices of truss web members, first by the weight of the installer standing on the cross-connector and finally by a wooden drive block and hammer.

Although the truss assembly uses no fasteners, it is exceptionally tight and sturdy when assembled. Due to the design, it will not loosen with use and time, but can be easily disassembled and reassembled without damage to any of the components.

Because the overall assembly is so tight, it takes a significant amount of force (an estimated 2,000 to 3,000 pounds of pull) to remove each end of a cross-connector from its seated position. To facilitate easy disassembly, a special disassembly tool is used to lever out the end of a cross connector. The disassembly tool consists of a lever which uses the top rail of the truss as a fulcrum, a chain to transfer lifting force down to the end of the cross connector and a hook to grab the end of the connector.

The lower portion of the disassembly tool, which is equal in length on both sides of the point of intersection, is designed to spread the force of the levering action out along the top truss rail to prevent bending the top rail mid-way between the truss web members. To keep the lower portion aligned with the rail, a bracket in the shape of a U is welded to each end. The U's are placed over the top rail of the truss and allow the lever device to pivot without loosing proper alignment. A plastic wrap can be added to prevent scratching of the paint on the top rail.

The top portion of the disassembly tool is unequal in length. With the bottom of the cross being the fulcrum point, the short portion of the cross is the lifting arm to which a chain is attached. The long portion is the lever arm. It may be necessary to slide a four foot long pipe over the lifting arm to provide enough leverage. This lever device has a notch at an end which will accept a chain, but a chain (or cable) may be permanently attached.

While it is simple and economical to make welded trusses of a fixed length, the truss and panel system of the present invention can, in an alternate embodiment, be much more versatile and easier to handle if the trusses can be shipped and assembled in sections. By this alternate embodiment, any length truss can be constructed from standard, two foot sections. Sections are easily stored, handled and transported. A broader choice is presented of durable coatings which may be applied to sections by a dipping and baking process.

Components can be reused to form any length ramp in two foot multiples. The economy of mass producing identical truss sections of short length can offset the higher cost of the additional steel and fabrication time.

In the sectional truss construction embodiment, truss sections are assembled on opposite sides with each opposing pair of sections joined by a cross-connector. If the truss sections for both sides are made identically, then the receiving ends of the truss sections on one side will face in the opposite direction from those on the other side. The use of cross-connectors and panels are the same as with the fixed length trusses.

Two adjoining truss sections are slipped together to form a four foot truss segment. Each section will span two feet, and the top railing height, after the ramp surface panels are installed, is 36 inches. The sections may be made in a wide range of matching sizes depending on their application, but two foot long sections appear to be the most practical for wheelchair ramp applications.

The top rail of each section is formed from a 24 inch long piece of 1.25" I.D. (1.5" outside diameter), schedule 40 pipe with a 20 inch long, 1.0" I.D. (1.25" O.D.), schedule 40 pipe inserted to a depth of 10 inches in one end and welded in place. The protruding 10 inches of 1.0" I.D. pipe slips inside the top rail of the next truss section to make a strong connection with a minimum of loose play.

A hole drilled and tapped in the 1.0" I.D. pipe which slides into the receiving end of the top rail of the next truss section aligns with a hole drilled in the underside of the receiving top rail when the two sections are fully slipped together. A bolt (a ⅜" diameter, hex drive, button head, stainless steel bolt), is then threaded in place to keep the two truss sections from slipping apart. The bolt is subject to very little strain and other types of fasteners such as a pin or cotter key could be used as substitutes although this type of round head fastener placed on the underside of the top rail presents the least chance of catching on an article of clothing or someone's hand.

The bottom chord section is fabricated from a 24 inch long piece of 2"×2"'3/16" angle with 1"×1"×16 gauge square tubing welded into the inside corner of the angle. At the bottoms of the truss sections, both sides of the truss sections have 1"×1"×16 gauge square steel tubing welded to the inside angle of the 2"×2"×3/16" bottom cord. One side has a length of ¾"×¾" ×3/16" square tubing inserted inside and welded in place while the other is open to receive the ¾" square tubing when the truss sections are slipped together.

The mating tubing does not have to be these dimensions nor does it need to be square (it can be round or rectangular), but the mating sizes should be such that the pieces slide together easily with little loose play. The overall width of the tubing should not be more than the width of the truss web tubing, which in a preferred embodiment is 1 inch. Wider tubing would not leave a lip along the bottom chord to support the edge of surface panels.

After two truss sections have been slipped together, the mating tubes are prevented from slipping apart by a screw, pin, cotter key or bolt which passes through aligning holes in the outer and inner tubes in the same way the top rail is held in position. A ⅜" diameter, hex drive, button head, stainless steel bolt is used. There is very little stress on the bolt.

Two truss sections are set up on opposite sides and joined by a cross-connector. The receiving ends of the truss sections face in opposite directions since they were made to go together on the same side. Using this design with smaller diameter tubing welded inside the larger diameter tubing, it is preferably to make left and right truss sections.

To avoid the necessity of making left and right truss sections, both bottom and top inside tubes can be interchangeably bolted or pinned to one side or the other of a truss section instead of welded. A sectional truss "kit" would consist of interchangeable left and right sections and the appropriate number of top and bottom insert tubes which would be held in place by a bolt or pin on each end. The end sections at the terminus of the top rail of a truss assembly can be finished off with a recurved insert, a plug, or a variety of connectors joining other railings.

Additional strength and stability can be added to a sectional truss assembly by adding a small, short pin or bolt welded directly to the lower edge of the cross-connector on each end where it rests on the lip of the bottom chord. This pin or bolt would align with a receiving hole in the lip of the chord and would insert into the hole as the cross-connector is seated down into the V of the truss webbing until the connector comes to rest on the lip. If a bolt is used, even more stability and strength may be achieved by using a nut to tighten the end of the bolt which protrudes below the truss chord.

It is therefore another object of the present invention to provide a truss and panel system to form an access ramp so as to bridge two areas of different elevation. This object is accomplished by two spaced trusses interconnected by cross members with panels inserted between adjacent cross-connectors.

It is another object of the present invention to provide a truss and panel system formed of two spaced trusses, each truss including a plurality of truss segments interconnected to form a truss of any length with cross-connectors interconnecting assembled, spaced trusses and with panels located in the spaces between adjacent cross-connectors.

It is still yet another object of the present invention to provide a truss and panel system which is quickly and easily assembled for bridging two areas of different elevation and which is capable of being disassembled for subsequent transport and reassembly.

It is still yet another object of the present invention to provide a truss and panel system assembled together to form spaced trusses having a top rail and an interconnecting profile section which supports, together with cross-connectors interconnecting the two spaced trusses, a plurality of panels supported by the cross-connectors and the trusses to form a continuous planar surface bridging two areas of different elevations.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
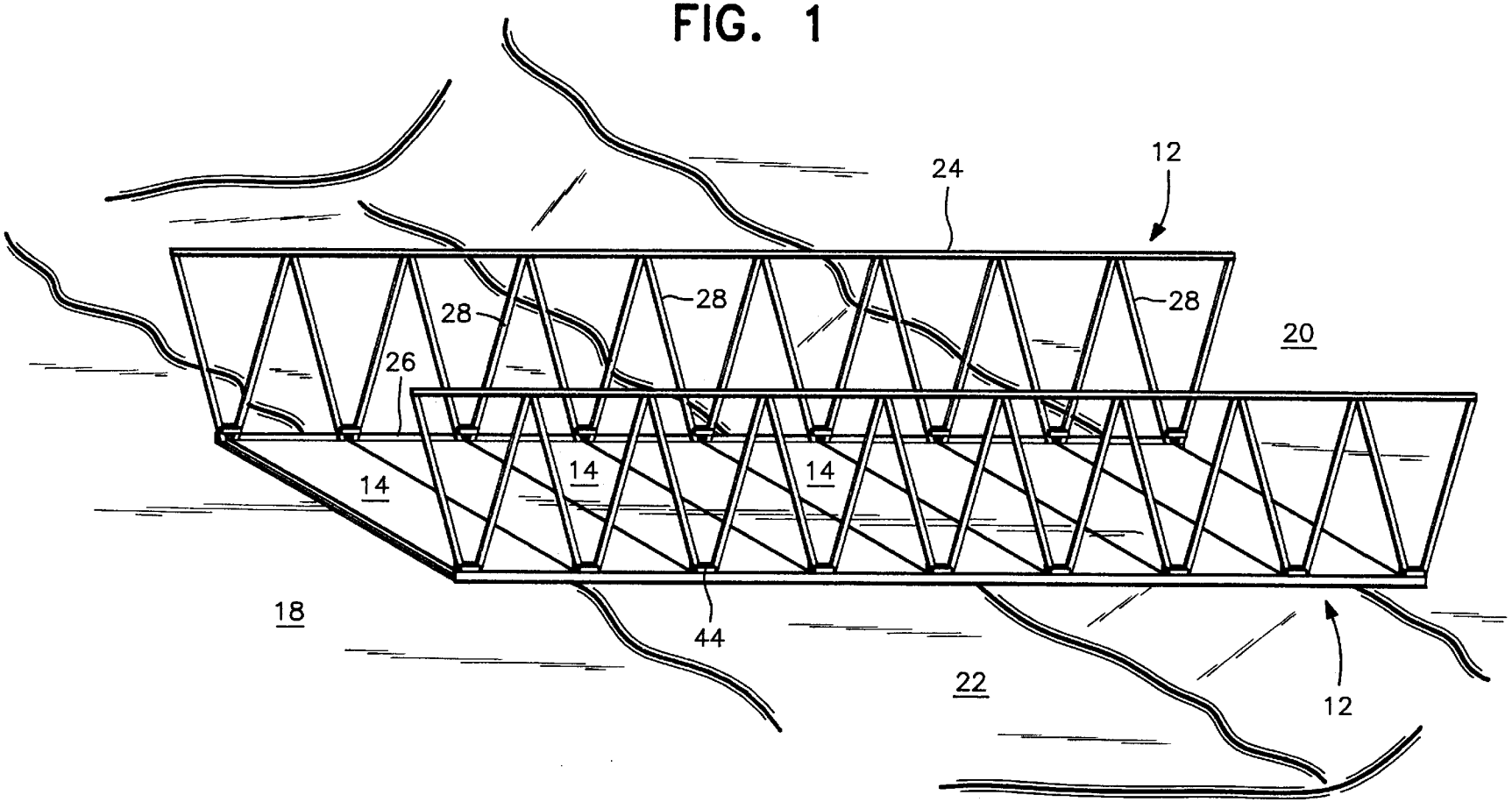
FIG. 1 is a perspective view of the truss and panel system of the present invention spanning two areas of different elevation so as to provide access between the two areas.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 4, in particular, a truss and panel system embodying the teachings of the subject invention is generally designated as 10. With reference to its orientation in FIG. 1, the truss and panel system includes two trusses 12, a plurality of rectangular shaped panels 14 and a plurality of cross-connectors 16 which interconnect the two trusses 12 and define a gap for insertion of the panels 14 so as to support the panels by the cross-connectors and the trusses.

In FIG. 1, the assembly 10 forms an access ramp to cross from one area 18 to an area 20 of higher elevation than area 18. In the example of FIG. 1, the system 10 bridges a recessed area 22 which separates area 18 from area 20. However, it is understood as being within the scope of the present invention that the system 10 can be used to form a bridge between areas of different elevations or to provide a smooth surface for traveling across an uneven terrain. By the system of the present invention, the requirements for the Americans with Disabilities Act are met.

Figure 2:
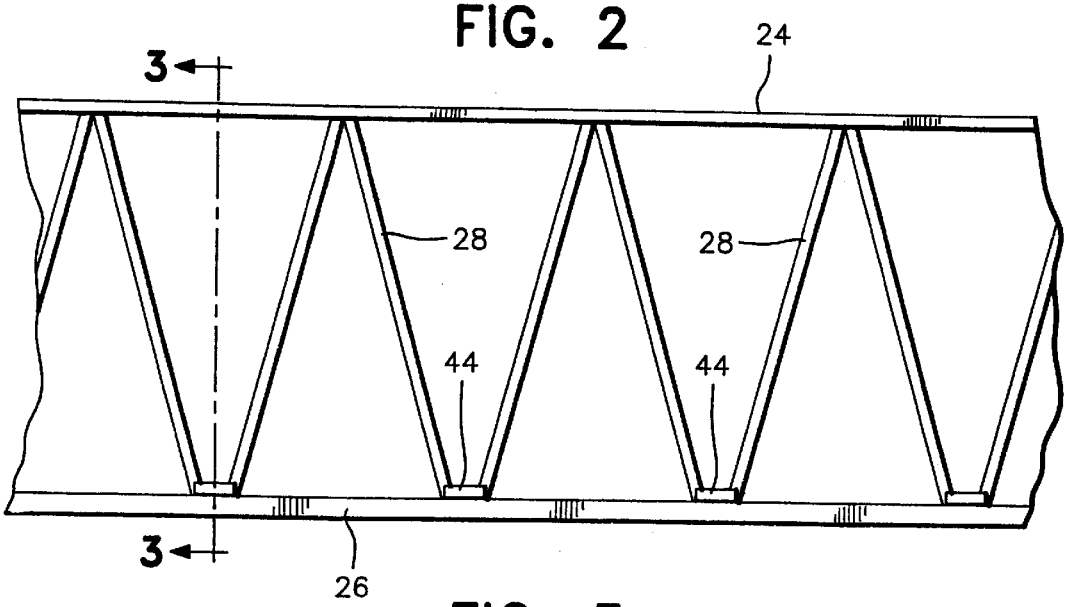
FIG. 2 is a side elevational view of a portion of one of the trusses.
Figure 3:
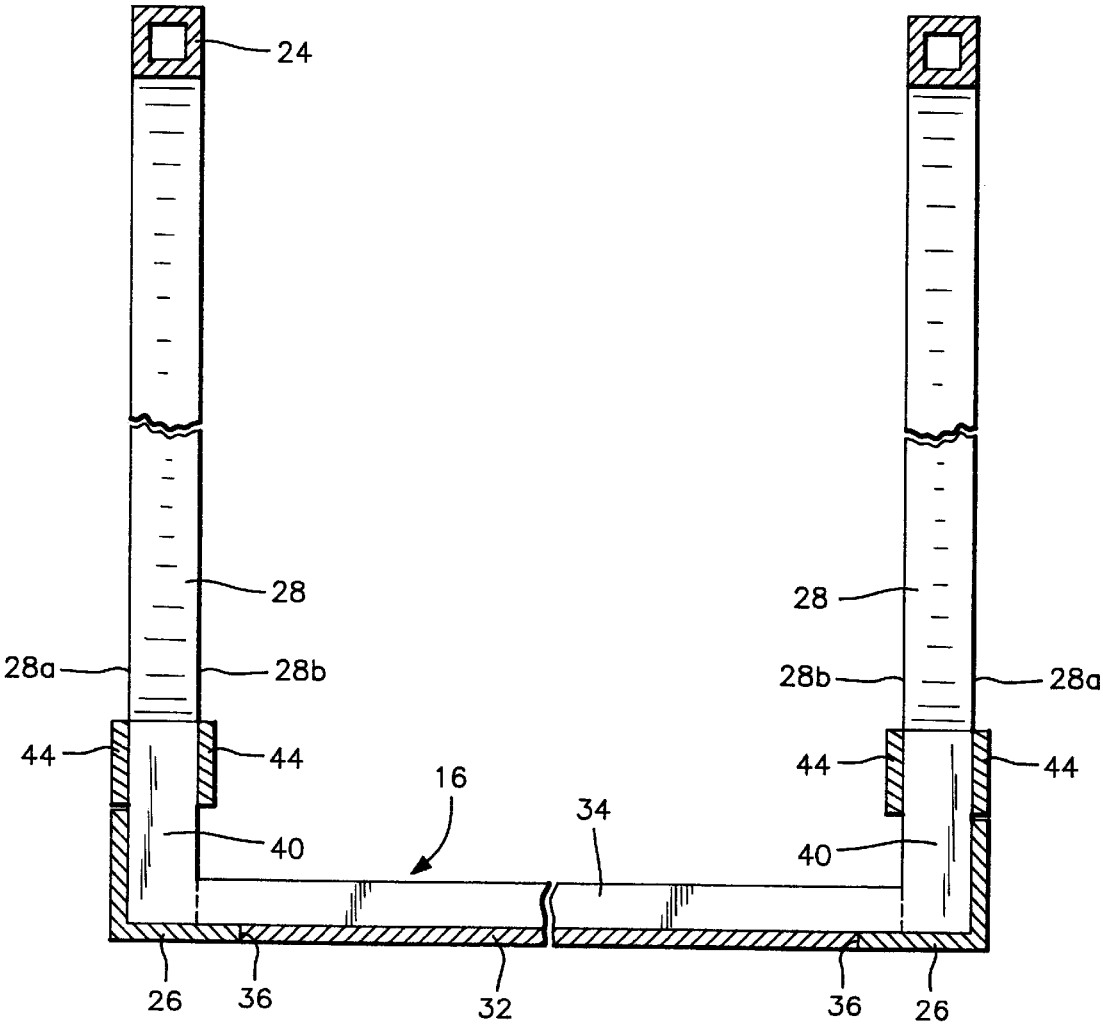
FIG. 3 is a sectional view taken along line 3—3 of FIG. 2.

As shown in FIGS. 1 through 3, each truss includes a top rail 24 formed of a square tube, a bottom chord 26 formed of an L-shaped steel section and interconnecting web members 28 which are welded to the top rail 24 and bottom chord 26.

As shown in FIG. 2, web members 28 are secured between the top rail and the bottom chord at an angle so that the upper end of the web members are secured adjacent to each other. However, at the bottom end of the web members 28, as shown in FIG. 4, a gap 30 of approximately one-fourth inch is formed.

Figure 4:
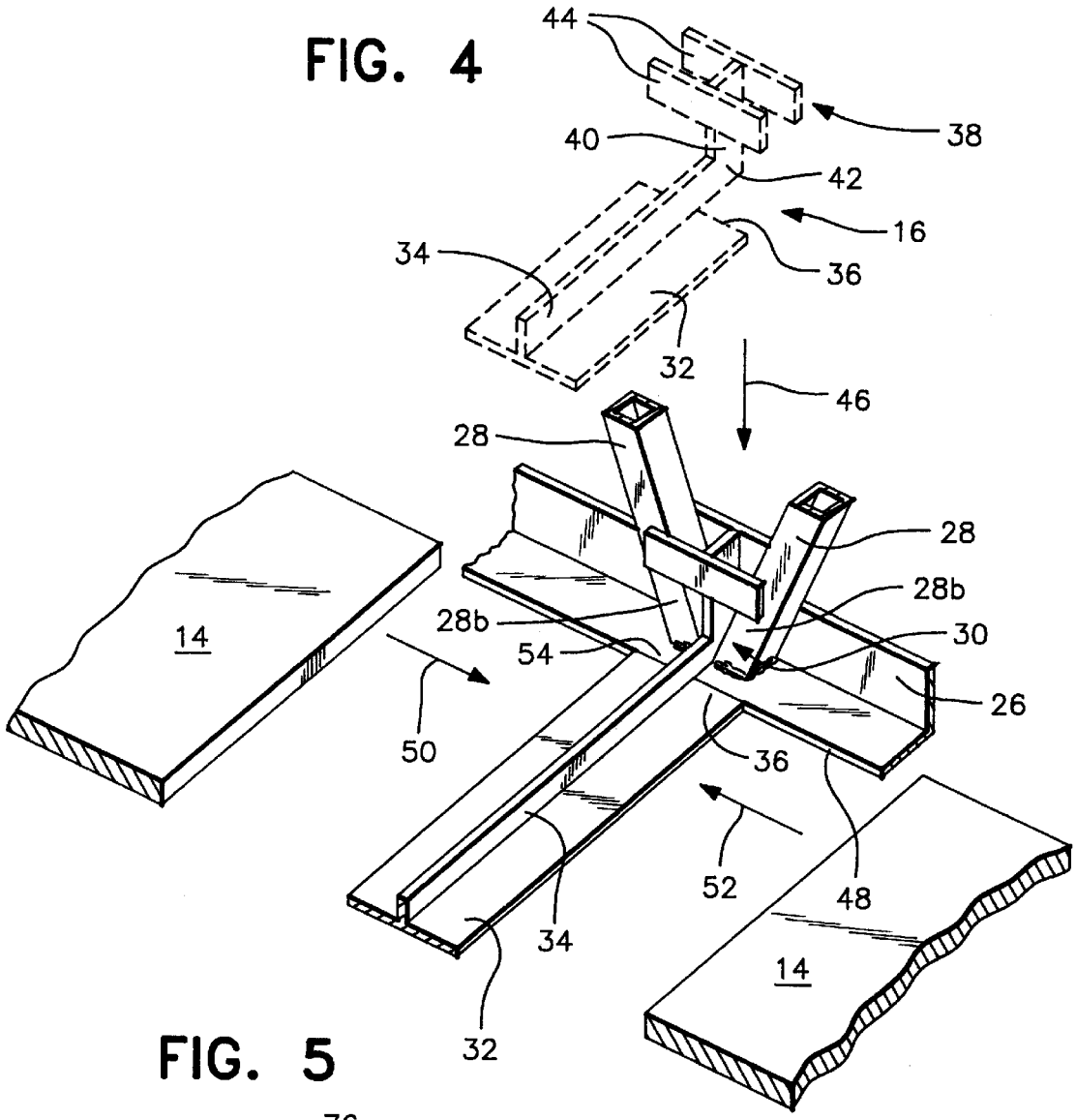
FIG. 4 is an exploded view of a section of a truss and a cross-connector having H-shaped ends with one end fitted into the separation between two web members of the truss and showing two spaced panels to be positioned on the L-shaped angle on the bottom chord of the truss and the bottom plate of the cross-connector. A cross-connector is also shown in phantom lines spaced from the truss to show its configuration prior to engaging with the bottom chord of the truss.

As shown in FIGS. 3 and 4, the cross-connectors 16 extending between the trusses 12 include a central flat plate portion 32. Secured to the plate portion 32, and extending perpendicular to the plate portion 32, is a central rib 34 which extends along the entire length of the plate portion 32 and beyond the terminal edges 36 of the plate portion 32. The height of the rib 34 is less than the height of the panels 14. The length of the plate portion 32 is dimensioned to define the size of the spacing between the trusses 12 so as to so as to accommodate the panels 14.

To secure the cross-connectors between the trusses 12, both ends of the cross-connectors 16 include an H-tab assembly 38, as best shown in FIG. 4. The H-tab assembly 38 includes a vertically rising plate portion 40 which extends from the end 42 of the rib 34. Extending parallel to each other and secured on opposite sides of the plate portion 40, are two tabs 44.

When the H-tab assembly 38 of the cross-connector 16 is lowered onto a truss 12, in the direction of arrow 46, shown in FIG. 4, the vertical portion 40 at end 42 of rib 34, fits between the ends of the web members 28 in the gap 30. Also, the spacing between the two tabs 44 is such as to position the tabs on opposite sides of the web members 28, to position one tab 44 against a laterally outer face 28*a* of the web members 28 and one tab against a laterally inner face 28*b* of the web members as is shown solid lines in FIGS. 3 and 4. In this mounted position, the edge 36 of the plate portion 32 abuts the edge 48 of the L-shaped steel section forming the bottom chord 26.

While assembling the cross connectors between trusses, as indicated by arrow 46, the rectangular panels 14 are moved in the direction of arrows 50 and 52 to abut against the rib 34 which has a lessor projection height above plate portion 32 than the thickness of the panels 14 such that panels 14 abutting against the rib 34 extend above the height of the rib 34. When the cross connectors are in the assembled position as shown in solid lines in FIG. 4, the panels are also supported along their side edges by a portion 54 of the L-shaped steel section forming the bottom chord 26 which is spaced from the web members 28.

Accordingly, by interconnecting two trusses with a plurality of cross-connectors and supporting panels by the bottom chords of the trusses and the cross-connectors between the trusses, a ramp, bridge or conveyance surface is quickly erected. The truss and panel system of the present invention can thereby be quickly and easily assembled for permanent or temporary installation.

Figure 5:
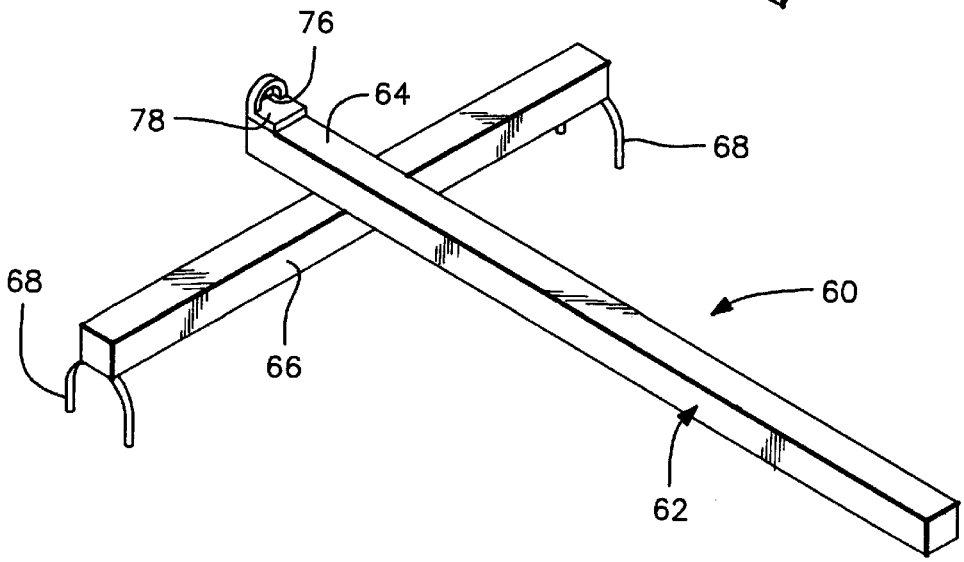
FIG. 5 illustrates a device for use in disassembling the truss and panel system of the present invention.
Figure 6:
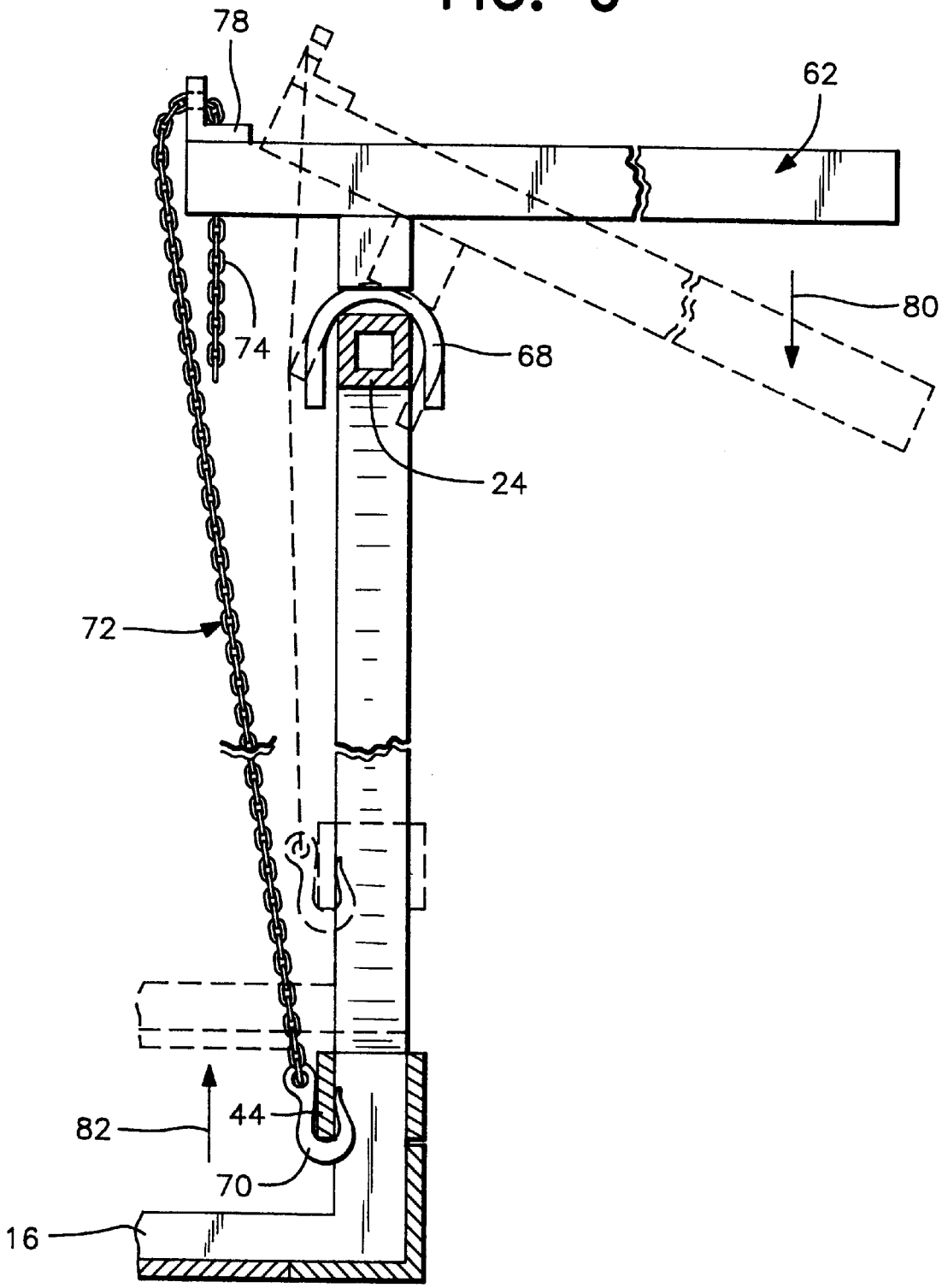
FIG. 6 illustrates the use of the disassembly device in combination with a chain and hook for engaging the cross-connector and lifting it up and out of contact with the bottom of the web members at the bottom chord of the truss.

If a temporary installation is envisioned, a removal tool 60, as shown in FIG. 5 is used as shown in FIG. 6. The tool 60 includes an elongated handle section 62. At end 64 of handle 62, a perpendicular extending stabilizing bar 66 is attached which includes two U-shaped mounting guides 68 at its opposite ends.

As shown in FIG. 6, to remove a cross-connector 16, a hook 70 located at one end of a length of chain 72 is secured around an inner tab 44 of the cross connector 16. The opposite end 74 of the chain 72 is threaded through an opening 76 in a adjustment block 78 mounted at end 64 of the handle 62.

The guides 68 are mounted to extend around spaced portions of the top rail 24, located above the cross-connector 16 to be removed. A force is then applied on the handle 62 in the direction of arrow 80 or on an extension bar surrounding the handle 62 so as to place a downward force on the free end of the handle. This force causes pivoting of the tool 60 about the guides 68 mounted on the top rail 24.

The hook 70 is thereby forced to move in the direction of arrow 82, to the position indicated in dotted lines, which illustrates the lifting of the cross connector from the gap 30 between the bottom end of the web members 28. After removal of the cross-connectors 16 and the associated panels 14, the trusses can separately be lifted and moved to a different location.

Figure 7:
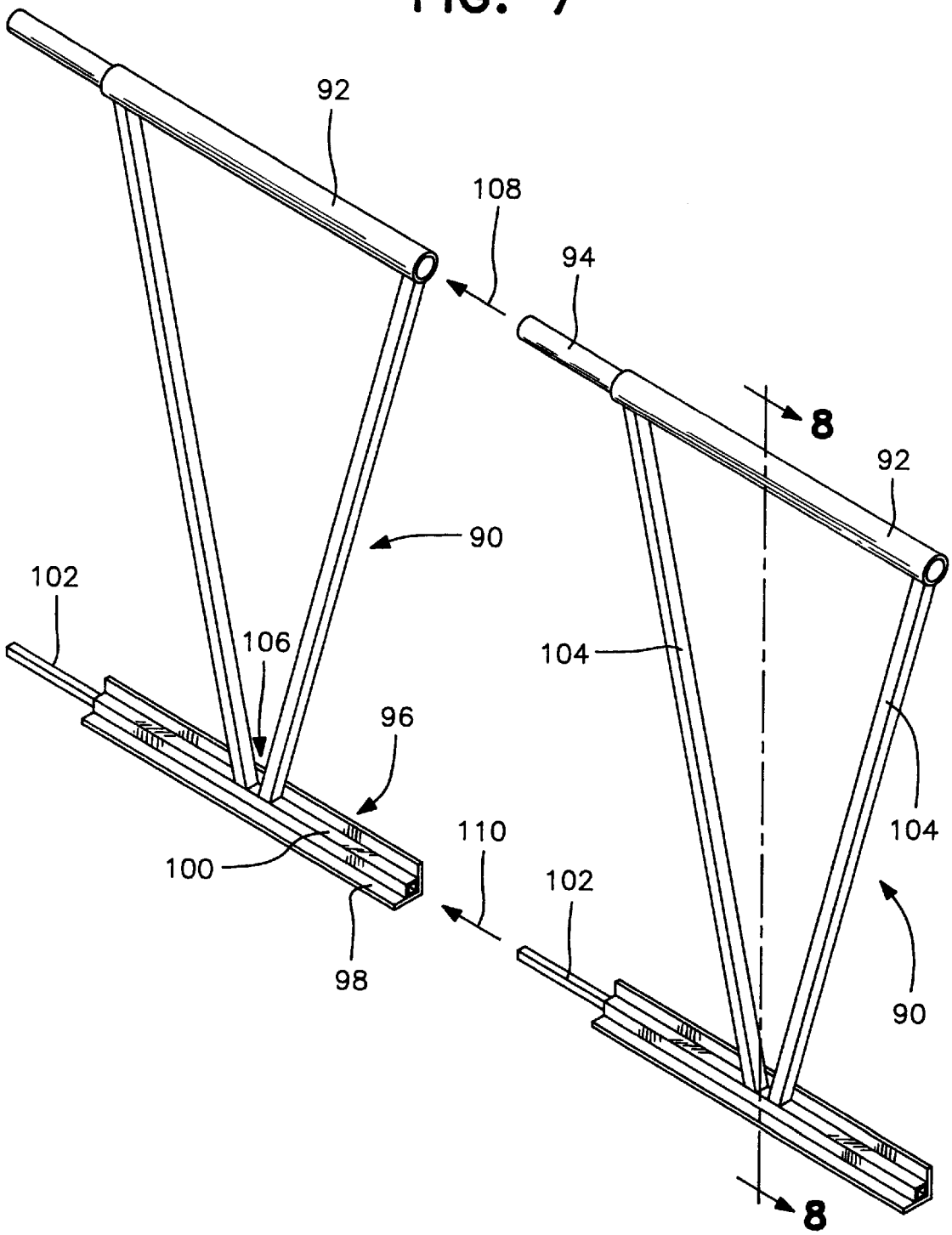
FIG. 7 illustrates an alternative embodiment of the present invention for forming trusses out of a plurality of sections.
Figure 8:
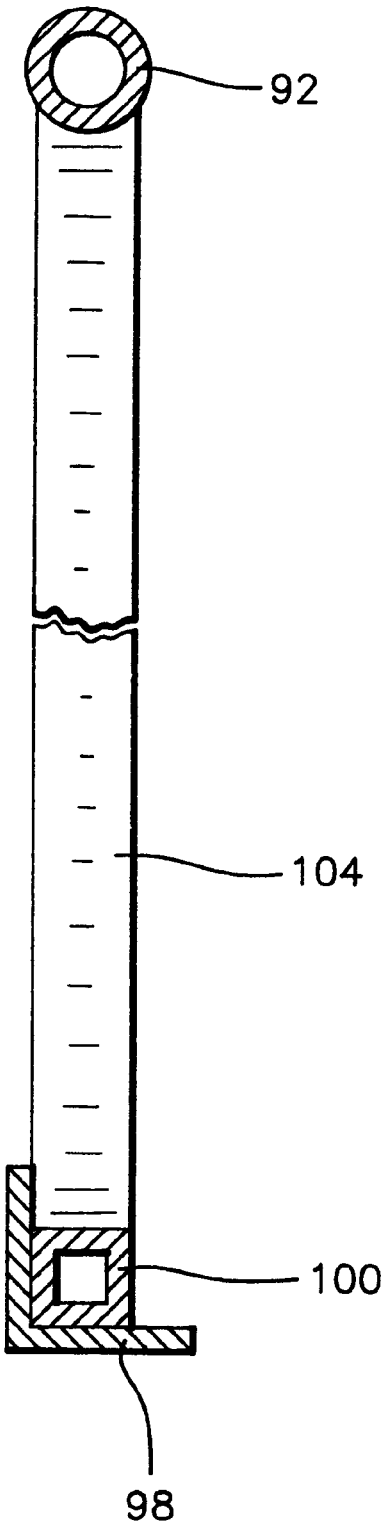
FIG. 8 is a sectional view taken along line 8—8 of FIG. 7.

In an alternate embodiment of the present invention, as shown in FIGS. 7 and 8, the cross connectors 16 and the panels 14 as shown in FIGS. 1–4 are also used. However, the trusses are of a different form.

In this embodiment, the trusses, rather than being of a fixed length can be of any length by the assembly of a plurality of truss sections 90. The truss sections 90 include a top rail 92, in this example, a hollow tube. Projecting from one end of the tube is a tube 94 of an exterior diameter substantially equal to the interior diameter of the top rail 92.

At the bottom chord 96, an L-shaped steel section 98 includes a hollow square shaped tube 100 secured to the two legs of the L-shaped steel section 98. Projecting from one end of the tube 100 is a square shaped tube section 102 having exterior dimensions substantially equal to the interior dimensions of the tube 100. Web members 104 interconnect the top rail 92 and bottom chord 96. The web members 104 form a gap 106 at the connection of their bottom ends to the bottom chord 96. This gap facilitates the connection of the cross-connector 16 with each truss assembled from a plurality of truss sections.

Accordingly, when one truss section 90 is moved with respect to an adjacent truss section in the direction of arrows 108 and 110, the tube 94 is inserted into the tube 92 of an adjacent truss section and the tube 102 is inserted into the open end of the tube 100 of an adjacent truss section. The number of truss sections 90 will determine the overall length of the assembled truss members. Additional stability is provided by passing a screw or a bolt through the interconnection of tube 94 within tube 92 and through tube 102 in tube 100.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A truss and panel system for forming access ramps, said truss and panel system comprising:

two trusses including a top rail, a bottom chord and web members extending between said top rail and said bottom chord, a gap located between two of said web members at said bottom chord, a plurality of cross connectors having opposite ends for interconnecting said two trusses by a friction fit, a plurality of panels supported by said cross connectors and said trusses to form a planar travel surface, and an H-tab assembly located at each of said opposite ends of said plurality of cross-connectors, said H-tab assembly including two parallel extending tabs to be positioned facing said web members of said trusses, and a portion of said H-tab assembly fitting in said cap with said friction fit.

2. A truss and panel system for forming access ramps as claimed in claim 1, wherein said cross connectors include a plate portion for supporting edges of said panels and including a rib extending perpendicular to said plate portion and being located between adjacent panels.

3. A truss and panel system for forming access ramps as claimed in claim 2, wherein said rib extends beyond edges of said plate portion with said edges of said plate portion being engaged by a bottom chord of said trusses.

4. A truss and panel system for forming access ramps as claimed in claim 1, further comprising a vertically extending portion of said H-tab assembly positioned in said gap.

5. A truss and panel system for forming access ramps as claimed in claim 4, wherein said vertically extending portion is secured to said two tabs.

6. A truss and panel system for forming access ramps as claimed in claim 5, further comprising a vertically extending rib extending from said vertically extending portion of said cross connector, said rib being located between adjacent panels.

7. A truss and panel system for forming access ramps as claimed in claim 1, wherein said trusses are each assembled by a plurality of interconnected truss sections.

8. A truss and panel system for forming access ramps as claimed in claim 7, wherein said truss sections include projections fitting into recesses of an adjacent one of said truss sections.

9. A truss and panel system for forming access ramps, said truss and panel system comprising:

two trusses, each of said two trusses including a top rail, a bottom chord and web members interconnecting said top rail and said bottom chord, a lower end of said web members being secured to said bottom chord to form a gap therebetween, a plurality of cross connectors having opposite ends, extending into said gaps between said lower end of adjacent web members and interconnecting said two trusses to define a separation distance between said two trusses, a plurality of panels supported by said cross connectors and a portion of said bottom chord of said trusses to form a planar travel surface between said bottom chords of said trusses, an H-tab assembly located at each of said opposite ends of said cross connectors, said H-tab assembly including two parallel extending tabs and a vertically extending portion secured to said two tabs, said H-tab assembly being positioned in said gap, and a vertically extending rib extending from said vertically extending portion of said cross connector, said rib being located between adjacent panels.

10. A truss and panel system for forming access ramps as claimed in claim 9, wherein said trusses are each assembled by a plurality of interconnected truss sections.

11. A truss and panel system for forming access ramps as claimed in claim 10, further comprising projections and recesses of said truss sections, said projections of said truss sections, fitting into said recesses of said truss sections.

12. A truss and panel system for forming access ramps, said truss and panel system comprising:

two trusses, each of said two trusses including a top rail, a bottom chord and inclined web members interconnecting said top rail and said bottom chord, a lower end of each of said inclined web members being secured to said bottom chord, a gap formed between two of said inclined web members secured to said bottom chord, a laterally outer face and a laterally inner face of said web members, a plurality of cross connectors interconnecting said two trusses to define a separation distance between said two trusses, each of said plurality of cross connectors having two ends, a plurality of panels supported by said cross connectors, a portion of said bottom chord of said trusses also supporting said plurality of panels, and a connector assembly located at each of said two ends of said plurality of cross connectors, said connector assembly including a vertically extending portion and a tab secured to and extending perpendicular to said vertically extending portion, said connector assembly being positioned with said vertically extending portion located in said gap between two inclined web members and said tab engaging said laterally outer face of said inclined web members for providing a secure interconnection of said two trusses.

13. A truss and panel system for forming access ramps as claimed in claim 12, further comprising a second tab for engaging said laterally inner face of said web members.

14. A truss and panel system for forming access ramps as claimed in claim 13, wherein said laterally inner face and said laterally outer face extend vertically.

15. A truss and panel system for forming access ramps as claimed in claim 13, wherein said second tab is secured to and extends perpendicular to said vertically extending portion.

16. A truss and panel system for forming access ramps as claimed in claim 12, wherein said vertically extending portion engages said two inclined web members forming said gap when said vertically extending portion is located in said gap.

17. A truss and panel system for forming access ramps as claimed in claim 12, further comprising a rib and a flat plate portion of said plurality of cross connectors, said rib is located centrally with respect to said flat plate portion and projects perpendicular to and above said flat plate portion, said rib terminating in said vertically extending portion of said connector assembly at each of said two ends of said plurality of cross connectors.

* * * * *